United States Patent [19]

Lausberg et al.

[11] 4,076,146

[45] Feb. 28, 1978

[54] DISHWASHERS AND DETERGENT DISPENSERS

[75] Inventors: Johannes Willebrordes Lausberg, Mulgrave; Denys Edward Downton, East Brighton, both of Australia

[73] Assignee: Gibson Chemicals International Pty. Limited, Revesby, Australia

[21] Appl. No.: 663,310

[22] Filed: Mar. 3, 1976

[51] Int. Cl.[2] ..... D06F 33/02; F04B 19/00

[52] U.S. Cl. ..... 222/52; 222/214; 222/57; 222/70

[58] Field of Search ..... 222/1, 52, 56, 57, 63, 222/64, 70, 206, 207, 209, 214; 417/413

[56] References Cited

U.S. PATENT DOCUMENTS

| | | | |
|---|---|---|---|
| 2,899,815 | 8/1959 | Hetrick | 222/207 X |
| 3,095,121 | 6/1963 | Douty et al. | 222/52 |
| 3,826,113 | 7/1974 | Noraas et al. | 222/70 X |
| 3,981,632 | 9/1976 | LeFebre | 417/413 |

OTHER PUBLICATIONS

Benedict, Electronics for Scientists and Engineers; 1967, pp. 422–424.

*Primary Examiner*—Robert B. Reeves
*Assistant Examiner*—Joseph J. Rolla

[57] ABSTRACT

A sensing and dispensing system for dispensing a first liquid to a reservoir, the dispenser comprising a pumping device having an inlet adapted to receive said liquid and an outlet adapted to be placed in communication with the reservoir and a control mechanism controlling operation of the pumping device whereby, in use of the dispenser to effect operation of the pumping device to pump a metered amount of the first liquid into the reservoir. The control circuit may include a sensor for detecting the commencement of delivery of another liquid to the reservoir or a detector for monitoring the conductivity of the liquid in the reservoir.

12 Claims, 5 Drawing Figures

DISHWASHERS AND DETERGENT DISPENSERS

BACKGROUND OF THE INVENTION

1. Field of the Invention

This invention relates to liquid dispensers and particularly, but not exclusively to such dispensers suitable for use in dispensing detergent in dishwashers.

2. Description of the Prior Art

Certain commercial dishwashers such as those used in hotels, restaurants, hospitals and other large organisations have a reservoir in which dishwashing water containing detergent is stored. In use of such dishwashers this water is pumped from the reservoir to wash the dishes during a washing cycle and the water in the reservoir is not fully changed at the end of washing each load of dishes but is used again for the next load of dishes. Further, such dishwashers also have a rinsing cycle in which fresh water is delivered to rinse them and the runoff of fresh water passes to the reservoir and causes a partial change thereof. This partial change of water in the reservoir may indeed be required by governmental and semi-governmental Health Departments, Rules and Regulations.

However, the partial change of water in the reservoir also results in a decrease in detergent concentration.

Various proposals have been made for replenishing the detergent without notable success.

BRIEF SUMMARY OF THE INVENTION

According to this invention there is provided a dispenser for dispensing a first liquid to a reservoir, said dispenser comprising a pumping device having an inlet adapted to receive said liquid and an outlet adapted to be placed in communication with said reservoir and control means controlling operation of the pumping device whereby, in use of the dispenser to effect operation of the pumping device to pump a metered amount of said first liquid into said reservoir.

The invention also provides a dishwasher of the type comprising a reservoir from which water containing detergent is drawn for washing dishes and means for delivering fresh water to the dishes for rinsing dishes and wherein at least part of which fresh water is thereafter passed to the reservoir thereby at least partially changing, and reducing the detergent concentration of the water in the reservoir, said dishwasher having a detergent dispenser comprising a liquid dispenser as described in the preceding paragraph, said inlet communicating with a supply of detergent and said outlet leading to said reservoir.

In one form of the invention said control means comprises a liquid dispenser as claimed in claim 1 wherein said control means comprises a timer circuit and sensing means adapted in use of the dispenser to sense the commencement of delivery of other liquid to said reservoir or to another container prior to subsequent delivery to the reservoir, the sensing means operating, in use of the dispenser and pursuant to said sensing, to activate the timer to thereby actuate said pumping device for a first predetermined time.

In an alternative form, the control means comprises detector means for detecting, in use of the dispenser, the electrical conductivity of liquid in said reservoir and first switch means operated under control of the detector means to cause actuation of said pumping device, said detector means being responsive to decrease in electrical conductivity of said liquid below a predetermined level to effect said operation of said first switch means and said actuation of the pumping device at least until sufficient said first liquid is added to the liquid in the reservoir to increase the conductivity at least up to said predetermined level.

Preferably the pumping means includes an electric motor and pump means actuable by the motor, said pump means comprising a diaphragm pump.

Also provided by this invention is a pumping device including a diaphragm pump connectable whereby, when operated, to supply of liquid.

Further, the invention provides a control circuit for regulating supply of electric current to an electrically operable pumping device for supplying liquid to a reservoir, said control circuit including timing means operable in use of the control circuit to operate said pumping device for a predetermined period.

Still further, the invention provides a control circuit for regulating supply of electrical current to an electrically operable pumping device for supplying a first liquid to a reservoir, said control circuit including sensing means connectable, in use of the device to sense the electrical conductivity of liquid in the reservoir and the control circuit, in use thereof, operating to effect operation of said pumping device in accordance with the conductivity of said liquid in said reservoir.

BRIEF DESCRIPTION OF THE SEVERAL VIEWS OF THE ACCOMPANYING DRAWING

The invention is further described with reference to the accompanying drawings in which.

DETAILED DESCRIPTION

Figure 1:
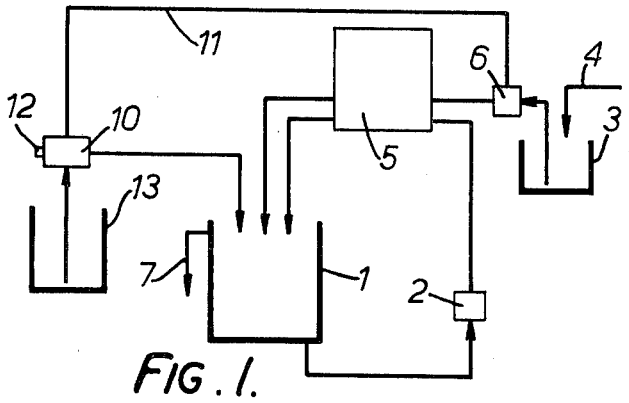
FIG. 1 is a schematic illustration of a dishwasher which is suppliable by a detergent dispenser in accordance with the present invention.

In FIG. 1 the dishwasher comprises a wash water reservoir 1 from which dish washing is drawn by a wash pump 2 for delivery to a washing compartment 5 of the dishwasher. The dishwasher also includes a fresh water tank 3 which is supplied from mains 4 and which is kept at constant level such as by a float valve.

When required, water is drawn from tank 3 by a rinse pump 6 and supplied to dishes to be rinsed by washing compartment 5 and thence passed to reservoir 1.

An overflow 7 to a drain (not shown) is provided for reservoir 1 and when fresh water is delivered by the rinse pump there will be overflow and detergent in the reservoir will be diluted.

In washing machines of this type, it is usual for the reservoir to be filled and fully emptied only once per day and, in the initial filling sufficient detergent for the water capacity of the reservoir is added thereto.

In a washing cycle water is drawn from the reservoir 1 by pump 2 and in a rinse cycle fresh water is delivered by pump 6.

Thus, since the fresh water causes overflow and dilution of detergent, it is desirable to restore the detergent concentration in the reservoir to the desired level before commencing a new wash cycle.

A detergent dispenser 10 is able, on receiving a control signal on a line 11 and generated pursuant to operation of the rinse pump to draw detergent from a detergent supply 13 and to deliver it to the reservoir 1. A push button 12A is also provided to allow manual operation of dispenser 10. Dispenser 10 is thus capable of restoring the detergent concentration and is also able to dispense an amount of detergent appropriate for the initial filling.

Figure 2:
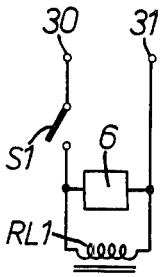
FIG. 2 is a diagram of an electric circuit connected to part of the dishwasher for supplying a signal to the dispenser.

Rinse pump 6 is operable from an alternating current supply (not shown) which is applied across terminals 30, 31, of the circuit shown in FIG. 2. Thus, one terminal of the pump motor is connected to supply terminal 31, directly, whilst the other is connected to supply terminal 30 via a switch S1. Switch S1 is closed, during normal operation of the dishwasher, by automatic means (not shown) associated with the dishwasher. This closing occurs at the beginning of a rinse cycle of the dishwasher. A relay coil RL1 is connected across the pump motor terminals as shown so as to be actuated whenever switch S1 is actuated to operate the pump motor. Actuation of relay RL1 causes closing of contacts RL1C1 in the electrical circuit of dispenser 10, as shown in FIG. 3, to initiate operation of the dispenser as now described.

Figure 3:
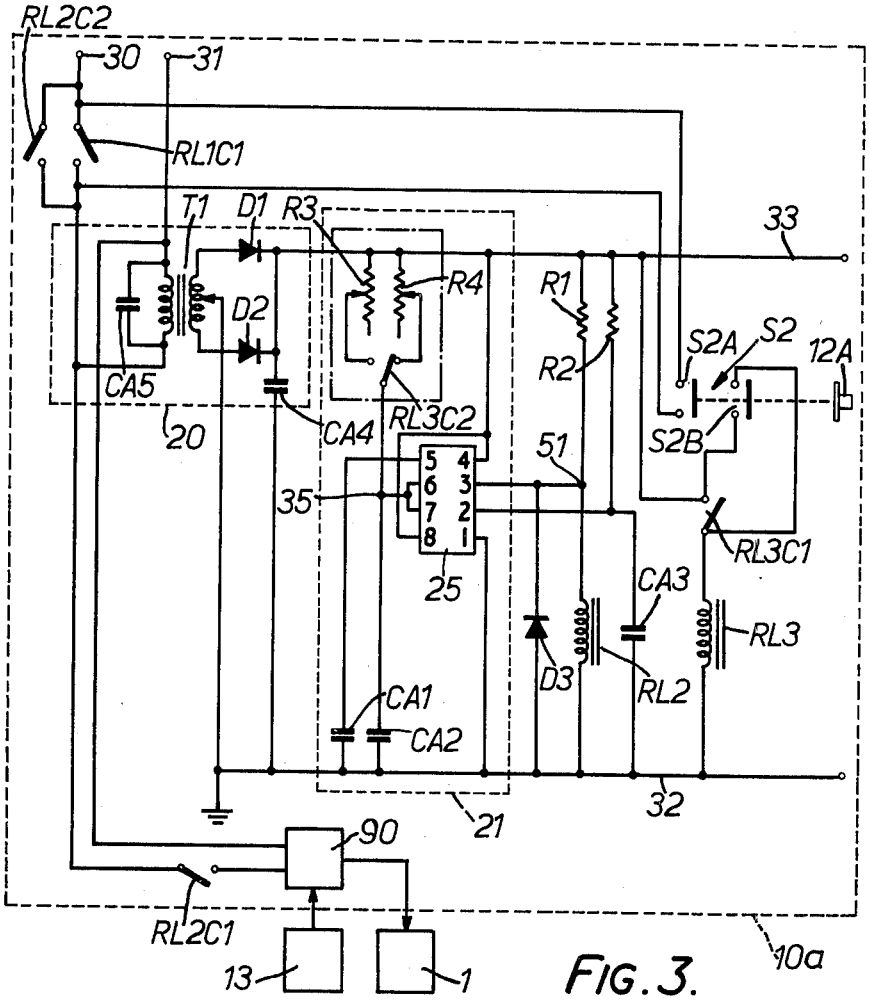
FIG. 3 is a diagram of the electric circuit of the dispenser and related parts.

The electrical circuit 10*a* of dispenser 10 is enclosed by dashed line 10*a* in FIG. 3 and includes a power supply circuit enclosed within a dashed line 20. This includes a transformer T1 having its primary winding connected across supply terminals 30, 31 via relay contacts RL1C1 controlled by relay coil RL1. The secondary of transformer T1 is centre tapped, the centre tap being connected to a supply ground rail 32. The ends of the secondary are coupled via solid state rectifiers D1, D2 to a main supply rail 33 for the dispenser. Rail 33 is connected by a filter capacitor CA4 to rail 32. The power supply circuit thus provides a full wave rectified DC supply, of 12 volts in this case, through diodes D1, D2 to supply rail 33. The primary of transformer T1 has a capacitor CA5 coupled thereacross to suppress undesired transient effects in the transformer.

A timer circuit enclosed within dashed line 21 is coupled between rails 32 and 33. It comprises a monostable multivibrator formed by an integrated circuit 25 and associated components. These associated components include a capacitor CA1 which provides a reference voltage to the integrated circuit and a timing network made up of a timing capacitor CA2 connected, via normally closed contacts RL3C2, in series with a potentiometer R4, this timing network being coupled between rails 32 and 33. Terminals 6 and 7 of integrated circuit 25 are coupled to the junction 35 between resistor R4 and capacitor CA2.

A relay coil RL2 is connected in series with a resistor R1, with the end of resistor R1 remote from the relay coil being connected to rail 33 and the end of the relay coil remote from resistor R1 being connected to rail 32. A diode D3 is connected across the relay coil the suppress transient effects caused by switching of the coil. The junction 51 between resistor R1 and relay coil RL2 is coupled to integrated circuit 25. In the stable condition of the timer circuit 21, the junction 51 is held at ground potential. This stable state corresponds to a condition where capacitor CA2 is charged substantially to the potential of supply rail 33.

Whenever switch S1 is operated to condition the dishwasher for rinsing, supply from terminal 30 is applied to energise rail 33 pursuant to closing of contacts RL1C1 by energisation of relay coil RL1. A negative going pulse is applied to one terminal of integrated circuit 25 when switching on of supply occurs. This occurs by reason of connection of the terminal 2 of the integrated circuit to the junction between a capacitor CA3 and a resistor R2. Capacitor CA3 and resistor R2 are in series across rails 32, 33. The negative going pulse initiates operation of timer 21. Capacitor CA2 will, at this stage, be uncharged so that junction 35 will be at ground potential operating integrated circuit 25 to place timing circuit 21 at its non-stable condition at which junction 51 between resistor R1 and relay RL2 is not grounded. Thus, relay coil RL2 is energised via resistor R1 from rail 33. This causes closing of contacts RL2C2 associated with relay coil RL2. These contacts bridge the contacts RL1C1 to latch the dispenser circuit in an energised state until both RL1 and RL2 are deenergised. At the same time, contacts RL2C1 also associated with the relay coil RL2 operate to couple a dispenser pumping device 90 of dispenser 10 to the supply from terminals 30, 31 thus energising pumping device 90 and causing detergent to be drawn up from detergent supply 13 to be delivered to reservoir 1.

Relay coil RL2 remains in its energised state until timing circuit 21 reverts to its stable condition. This reversion occurs after the time delay corresponding for the time taken for capacitor CA2 to charge through potentiometer R4. Upon charging of capacitor CA2, integrated circuit 25 is actuated to ground terminal 51 and relay coil RL2 is deenergised to open contacts RL2C1, RL2C2. The opening of the latter contacts interrupts supply to pumping device 90 to bring about cessation of pumping. When switch S1 is opened again pursuant to completion of supply of rinsing water to compartment 5 during normal operation of the dishwasher, contacts RL1C1 are opened because of the deenergisation of relay coil RL1. It should be noted, though, that the opening of contacts RL1C1 does not affect the period of time for which pumping device 90 is operated, since if contacts RL1C1 should open before contacts RL2C2 supply to the pumping device will still be maintained by contacts RL2C2 and it is only if contacts RL2C2 should open before opening of switch S1 that supply to the pumping device will be interrupted by opening of contacts RL1C1.

It will be appreciated that automatic actuation of dispenser 10 occurs by the above process each time rinse water is drawn from tank 3. In order to introduce an initial quantity of detergent into reservoir 1, for example at the beginning of a day, operation of pumping device 90 may be required to be carried on for a different period to the period for which operation would take take place on each cycle of operation of the dishwasher. In order to produce the initial quantity of detergent, push-button 12A is momentarily operated to operate a switch S2 associated therewith. Switch S2 has two pairs of contacts S2A, S2B. Contacts S2A are connected to bridge the contacts RL1C1 so that when push-button 12A is operated supply is applied to the dispensing circuit 10*a*. At the same time, contacts S2B are also closed and these are connected to effect energisation of a relay coil RL3 from rail 33. Relay coil RL3 is latched in the energised condition upon such actuation by its own relay contacts RL3C1 which bridge switch S2B. As in the case of automatic operation, the initiation of supply to the dispensing circuit, caused in this case by momentary operation of switch S2, causes latching of the circuit 10*a* in the energised condition, by virtue of operation of relay coil RL2 and closing of its contacts RL2C2 to maintain supply to the circuit. Relay coil RL2 is then maintained in the energised condition for a predetermined time, in the same way as during automatic operation, by virtue of operation of multivibrator 21. However, relay coil RL3 has a set of contacts RL3C2 which normally operate to couple capacitor CA2 in series with potentiometer R4. However, when relay coil RL3 is energised, these contacts are operated to switch a second potentiometer R3 in series with capacitor CA2 instead of potentiometer R4. Accordingly, actuation of relay coil RL2 and corresponding operation of pumping device 90 by closing of contacts RL2C1 occurs for a predetermined time which, in this case, is established by the value of potentiometer R3 rather than the value of potentiometer R4. Upon reversion of timer 21 to its stable condition, relay coil RL2 is deenergised thereby opening contacts RL2C2 and interrupting supply to the circuit 10*a*. Then, relay coil RL3 is deenergised because of loss of supply on rail 33. This causes contacts RL3C2 to again connect potentiometer R4 in series with capacitor CA2 thus readying the dispenser for automatic dispensing operation.

The magnitude of the resistance established by adjustment of potentiometer R3 is determined having regard to the volumetric rate with time of supply of detergent by pump 90 and will be such as to provide a predetermined amount of detergent for the initial filling. It may thus be set in the field to suit desired conditions which may vary due to hardness of water besides variation in type of dishwasher. In general, the potentiometer R3 may be set so that the timer runs for a period of from 0 to 5 minutes.

The magnitude of the resistance established by adjustment of potentiometer R4 is determined having regard to the volumetric rate with time of supply of detergent by pump 90 and will be such as to provide a predetermined amount of detergent for restoring the detergent concentration. It may thus be set in the field to suit desired conditions which may vary due to hardness of water besides variation in the type of dishwasher. In general, the potentiometer R4 may be set so that the timer runs for a period of from 0 to 60 seconds.

The following specific Example is given to further illustrate this invention:

EXAMPLE

A dishwasher with a reservoir 1 to 10 gallon capacity was to be used in an area with a water hardness such that a 0.1% by volume detergent concentration of detergent solution was required. Thus, 1.6 fluid ounces (45.6 ml) of the detergent solution was needed in the initial fill and, as the detergent pumping device 90 used had a rate of delivery of 48 ml/minute, potentiometer R3 was set so that the detergent pumping device would operate for 95 seconds.

In the rinse operation the particular dishwasher overflowed 1 gallon of water. Thus to restore the detergent concentration to 0.1% it was necessary to add 0.16 fluid ounces of the detergent solution and thus potentiometer R4 was set so that the pumping device would operate for 9.5 seconds.

Figure 4:
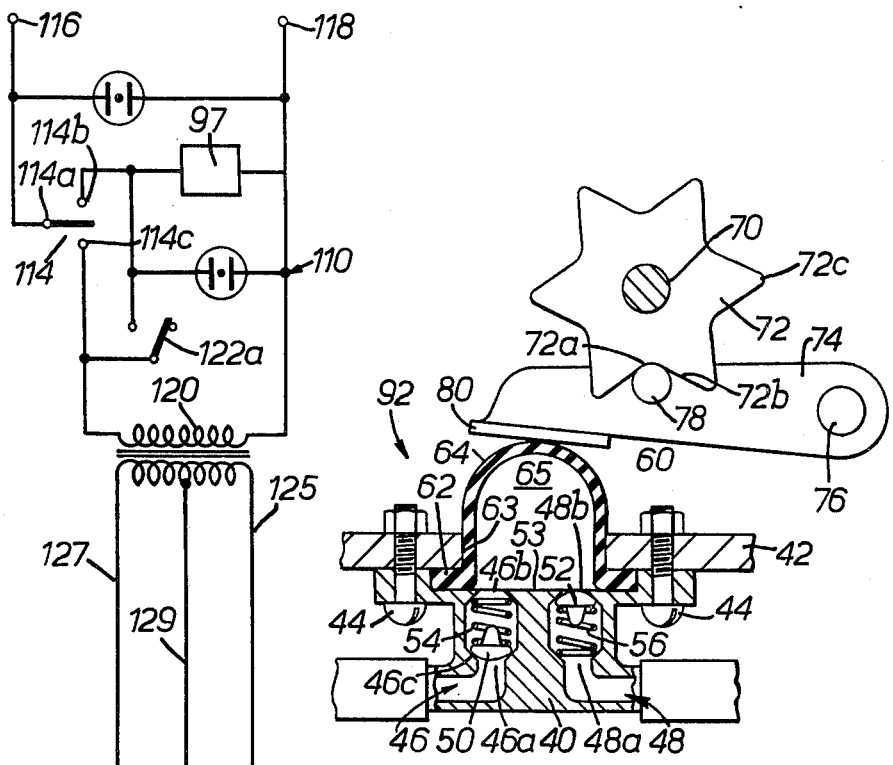
FIG. 4 is a fragmentary section of a pump incorporated into the dispenser of FIG. 3.

Pumping device 90 preferably includes an electric motor connected to drive a diaphragm pump 92 of the kind shown in FIG. 4. This includes a body 40 which is affixed to the casing 42 for the dispenser 10. The body is affixed on the exterior of the casing by means of screws 44. Body 40 has inlet and outlet passageways 46, 48 respectively. These enter the body from opposed sides thereof and in aligned disposition and thence undergo 90° bends to form two portions 46*a*, 48*a* which extend in parallel side-by-side relationship to openings 46*b*, 48*b* in a rear face 51 of body 40. Portions 46*a*, 48*a* are relatively enlarged in diameter as compared with the remainder of the passageways and present annular valve seats 46*c*, 48*c* therein. Mushroom valve elements 50, 52 are contained within respective portions 46*a*, 48*a* and these are spring biased against the respective valve seats 46*c*, 48*c* by helical compression springs 54, 56 within portions 46*a*, 48*a*.

A generally "hat" shaped resilient diaphragm 60 has a rim 62 which is clamped between the rear face 53 of body 40 and the exterior surface of casing 42. A domed central portion 64 formed integrally with rim 62 extends rearwardly from the rear face of body 40 and through an aperture 63 in casing 42 so as to project internally of the casing. Domed portion 64 and body 40 define closed cavity 65 one wall of which is resiliently deformable by virtue of the deformability of domed portion 64.

The orientations of valve seats 46*c*, 48*c*, and the cooperating valve elements 50, 52 are so arranged that, by inwardly deforming domed portion 64 of diaphragm 60, increase in fluid pressure in cavity 65 will operate to aid spring 54 in maintaining valve element 50 closed but will act in opposition to spring 56 to open valve element 52. Thus, fluid in cavity 65 can pass valve element 52 and along passageway 48, whereas reverse flow down passage 46 is precluded. Resilience of diaphragm 60 is such that upon release of such compression and deformation thereof it will revert to its initial relatively expanded state and in so doing relatively decrease the fluid pressure within cavity 65 so as to open valve element 50 and draw fluid in to the cavity through passageway 46, whilst maintaining valve element 52 closed.

An output drive shaft 70 is driven directly by the motor for pump 92 or through a reduction gear. A star-shaped cam wheel 72 is affixed on shaft 70. A lever 74 is mounted at one end of shaft 70 for pivotal movement about an axle 76 and has a projecting cam follower element 78 thereon. Cam follower element 78 engages the periphery of cam wheel 72, the arrangement being such that when cam wheel 72 is at the position shown in the drawing, where cam follower element 78 engages a portion 72*a* of minimum radius between two cam lobes 72*c* of cam wheel 72, an end plate 80 at the free end of arm 74 just rests upon the outermost end of diaphragm 60 without deforming the diaphragm. However, by rotation of shaft 70 pursuant to operation of the pump motor, arm 78 is pivoted, in a clockwise direction shown in FIG. 4, by contact with a progressively increasing radius portion 72*b* of a lobe 72*c* of cam wheel 72 to press plate 80 towards casing 42 thereby inwardly deforming diaphragm 60 to decrease the interior volume thereof. It will be seen that there are, in this case, six lobes 72*c* on cam 72 and continuous operation of the pump motor thus causes these to successively and repeatedly operate arm 74 to compress and then release diaphragm 60. These compressions and releasings cause pumping of fluid in from passageway 46 and out through passageway 48 as previously described. The shaping of lobes 72*c* is arranged to minimise compression of diaphragm 60.

Figure 5:
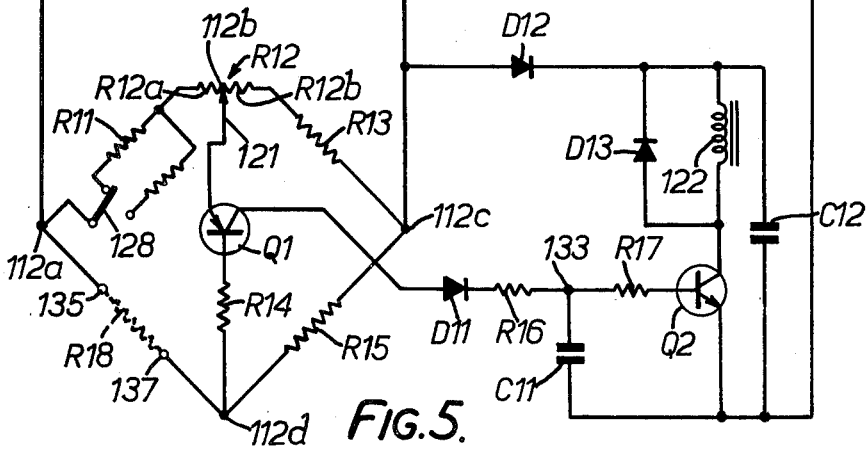
FIG. 5 is a circuit diagram of an alternative electric circuit for the dispenser.

FIG. 5 shows an alternative electric circuit 95 for dispenser 10. This circuit is operable to manually effect operation of the dispenser pump motor for a desired time interval and is also conditionable to dispense detergent by operation of the pump motor whenever the concentration of detergent in liquid in reservoir 1 falls to a predetermined level. The circuit includes an operating circuit 110 which is manipuable to a condition for the aforementioned manual actuation of the pump motor and also to a condition in which the aforementioned automatic operation is effected under control of a control circuit 112 also forming part of the dispenser circuit 95.

Circuit 110 includes a switch 114 which controls supply of electric current to the pump motor, here designated 97, and from terminals 116, 118 of an alternating current supply. Switch 114 has a movable contact 114*a* coupled directly to terminal 116 and two fixed contacts 114*b*, 114*c*. Movable contact 114*a* is manually actuable to engage either contact 114*b* or contact 114*c* and also to position it at an off position at which no connection is made from contact 114*a*.

Contact 114*b* of switch 114 is connected to one side of motor 97 and terminal 118 is connected to the other side of motor 97. Thus when switch contact 114*a* is manually positioned to engage contact 114*b*, electric current is supplied directly from terminals 116, 118 to motor 97 to enable an operator to effect operation of dispenser 10 to deliver a desired quantity of detergent to the liquid in reservoir 1.

Contact 114*c* is connected to one side of the primary winding of a transformer 120, the other side of this primary winding being connected to supply terminal 118. Transformer 120 provides a supply to circuit 112 so that this circuit is energised when switch 114 is positioned for automatic operation of the dispenser.

Circuit 112 operates to control supply of electric current to motor 97 via contacts 112*a* in circuit 110. These contacts are connected between one side of the motor 97 and contact 114*c* of switch 114 in such a way that they will only operate to control supply of current to motor 97 when circuit 110 is appropriately conditioned for automatic operation.

Circuit 112 receives a low voltage supply from a secondary of transformer 120. This secondary provides an alternating current supply of 24 volts between lines 125, 127 attached to ends of the secondary whilst there is a tapping intermediate the ends of the secondary winding which provides a 15 volt alternating current supply between line 125 and a line 129 connected to the tapping. Line 127 is connected via a switch 128 through a resistor R11, a potentiometer R12 and a resistor R13 to line 129. The emitter of a PNP transistor Q1 is connected to the movable contact 121 of potentiometer R12 while the collector of this transistor is connected through a diode D11, a resistor R16 and a capacitor C11, all connected in series, to line 125. The base of transistor Q1 is connected to one end of a resistor R14, the other end of this resistor being connected via a resistor R15 to line 129. A relay coil 122 for operating relay contacts 122*a* is connected at one side through a diode D12 to line 129. The other side of coil 122 is coupled to the collector of an NPN transistor Q2. Transistor Q2 has its emitter connected to line 125 and its base connected via a resistor R17 to the junction 133 between resistor R16 and capacitor C11.

In order to introduce into circuit 112 a parameter representing the electrical conductivity of liquid for reservoir 1, two electrodes 135, 137 are provided. These are shown only diagramatically in FIG. 5, but are positioned within the reservoir 1 so as to be at spaced locations within the liquid in the reservoir. The electrodes provide electrical connection to the liquid and are insulated from each other otherwise than by conduction through the liquid. Thus the liquid between the electrodes presents an apparent resistance, represented as R18 in FIG. 5. The electrode 135 is connected to line 127 whilst electrode 137 is connected to the junction between resistors R14 and R15.

As will be apparent from inspection of FIG. 5, the resistors R11, R13 and R15, together with potentiometer R12 and resistance R18 together define four arms of a bridge circuit with four corner junctions here designated 112*a*, 112*b*, 112*c* and 112*d*. The arms of the bridge circuit are constituted as follows:

First arm, between junctions 112*a* and 112*b* — resistor R11 in series with a portion R12*a* of potentiometer R12.

Second arm, between junctions 112*b*, 112*c* — the remaining portion R12*b* of potentiometer R12 in series with resistor R13.

Third arm, between junctions 112*c*, 112*d* — resistor R15.

Fourth arm, between junctions 112*d*, 112*a* — resistance R18.

When transformer 120 is energised a nine volt alternating current supply is applied across opposed junctions 112*a*, 112*c* of the bridge circuit, by reason of the effective connection of these junctions to lines 127, 129. On the other hand, the emitter-base junction of transistor Q1 is effectively connected to be sensitive to any out of balance voltage across opposed junctions 112*b*, 112*d* of the bridge circuit.

In operation of the circuit 112, and when resistance R18 is large, the potential at junction 112*d* will more closely approach that of terminal 112*c* than will be the case when resistance R18 is small. The values of the resistors R11, R13, R15 and the setting of potentiometer R12 are arranged such that in this case, and on positive half cycles of supply on line 127 transistor Q1 will have its emitter-base junction forwardly biased by reason of an out of balance voltage applied across junctions 112*b*, 112*d*. Since in this case, the collector of the transistor will be effectively at a low potential by reason of the connection thereof to line 125 via diode D11, resistor R16 and capacitor C1, the transistor will turn on. On negative half cycles this situation will not prevail, the emitter being negative relative to the base so that the transistor will be turned off. When resistance R18 is small the potential of junction 112*d* will more closely approach that of junction 112*a* and on positive half cycles of the supply the emitter of transistor Q1 will be relatively at a negative potential with respect to the base and the transistor will be turned off. This condition will also prevail on negative half cycles since, although the emitter-base junction will then be forwardly biased, the base-collector junction, and diode D11 which is in series with this, have a reverse voltage applied thereacross from line 127 to line 125.

It will be seen, therefore, that as resistance R18 increases from a value at which transistor Q1 is turned off, turn on will occur at some point which is determined by the relative values of resistors R11, R13 and R15 and by the setting of potentiometer R12. The conductivity of liquid in reservoir 1 is dependent upon the quantity of washing detergent therein, the conductivity decreasing as dilution of the detergent occurs. Thus, by appropriate setting of potentiometer R12 turn on of transistor Q1 can be made to occur whenever the concentration of detergent is reduced to a minimum desired level.

The effect of turn on of transistor Q1 is to allow capacitor C11 to charge, on positive half cycles of the supply on line 127. This charging occurs through resistor R11, part 12*a* of potentiometer R12, transistor Q1, diode D11 and resistor R16. After a time delay determined by the time taken by capacitor C1 to charge, transistor Q2 is turned on to energise relay coil 122. This energisation occurs by reason of current flow on positive half cycles appearing on line 129 through diode D12, coil 122, from collector to emitter of transistor Q2, and thence to line 125. Energisation of coil 122 operates contacts 122*a*, as described previously, to operate motor 97 and supply detergent. When the addition of detergent has caused a sufficient rise in conductivity of liquid in reservoir 1, resistance R18 is reduced to a value which will cause turn-off of transistor Q1. Then, capacitor C11 discharges through resistor R17 and the base-emitter junction of transistor Q2. After a time delay determined by the size of resistor R17, transistor Q2 is turned off to stop motor 97. This time delay is chosen so that detergent addition is continued above a concentration which might be likely to cause substantially immediate switching on of transistor Q1, in order to prevent "hunting".

The diode D13 across relay coil 122 and the capacitor C12 connected between line 125 and the junction between coil 122 and diode D12 are provided merely to promote more effective operation of relay coil 122 and its contacts 122*a* in a manner known per se.

The circuit of FIG. 5 can readily be adapted to be actuated at a desired concentration of detergent by a simple adjustment of potentiometer R12, and if an insufficient range of adjustment is provided by this, a resistor R11*a*, as shown, may be coupled so that it can be switched by operation of switch 128 to replace resistor R11.

The dispenser 10, whether it incorporates a circuit as described with reference to FIGS. 2 and 3, or as described with reference to FIG. 5, is preferably formed as a unit which can be mounted on a dishwasher in any convenient location. Thus casing 42 may suitably enclose both the pump 92 together with its motor and the electrical components of the dispenser.

The described dispenser is particularly satisfactory because of the use of detergent in liquid form, whereas, in the past, it has been customary to use powdered detergent which must be mixed with water before use.

The dispenser also has a number of advantages. Particularly the use of the described diaphragm pump has been found to minimise blockages likely to occur in venturi devices as used in the past and provide very satisfactory service, in comparison with prior devices which, generally, utilise injector apparatus. The pump also minimises likehihood of air blocks effecting operation of the dispenser whilst, furthermore, there is no need to plumb into the water mains supply of the dishwater, if the dispenser is to be attached to an already installed dishwasher.

Various modifications may be made to the dispenser. For example, in the circuit shown in FIG. 3, switch S2 could be automatically operated by a relay on initial filling. In the embodiment described with reference to FIG. 5, alternative forms of conductivity sensor may be employed.

These and many other modifications may be made to the described arrangement without departing from the spirit and scope of the invention as defined in the appended claims.

We claim:

1. A liquid dispenser for dispensing a first liquid to a reservoir, said dispenser comprising a pumping device having an inlet adapted to receive said liquid and an outlet adapted to be placed in communication with said reservoir, and control means controlling operation of the pumping device and effecting operation of the pumping device to pump a metered amount of said first liquid into said reservoir, said control means comprising a timer circuit, and sensing means adapted to sense the commencement of delivery of other liquid to said reservoir, said sensing means operating, during use of the dispenser and pursuant to said sensing, to activate the timer circuit to thereby actuate said pumping device for a first predetermined time, said timer circuit including a monostable multivibrator, said sensing means including first switch means actuated, in use of the dispenser, to activate the multivibrator by application of electric supply thereto, said timer circuit further including second switch means operated, pursuant to said application of supply to the multivibrator, to effect said actuation of the pumping device by switching electric supply thereto, said multivibrator being switched to a first state upon said application of said supply thereto at which state said actuation of the second switch means is not precluded, but passing to a second state after said predetermined time at which the second switch means is deactuated to end dispensing, said timer circuit further including latching means for latching said second switch means following application of supply to said multivibrator, until deactuation thereof under control of the multivibrator occurs, irrespective of any intervening deactuation of said first switch means.

2. A liquid dispenser as claimed in claim 1 wherein said multivibrator includes one or more active circuit elements switched in accordance with a degree of charge of a capacitor connected thereto, the capacitor being connected to charge through a resistor from said supply when the first switch means is actuated whereby the multivibrator is switched to a condition corresponding to said second state when a predetermined charge level of said capacitor is reached, and after said first predetermined time.

3. A liquid dispenser as claimed in claim 1 including third switch means operable to apply supply to said multivibrator to initiate operation thereof and to thereby effect operation of the second switch means for a second predetermined time under control of said multivibrator.

4. A liquid dispenser as claimed in claim 3 wherein said latching means operates to latch said second switch means in the actuated condition, until deactuated under control of said multivibrator, irrespective of intervening deactuation of the third switch means.

5. A liquid dispenser as claimed in claim 4, wherein said multivibrator including one or more active circuit elements switched in accordance with a degree of charge of a capacitor connected thereto, the capacitor being connected to charge through a resistor from said supply when the first switch means is actuated whereby the multivibrator is switched to a condition corresponding to said second state when a predetermined charge level of said capacitor is reached, and after said first predetermined time.

6. A liquid dispenser as claimed in claim 5 including fourth switch means operated in response to actuation of the third switch means to disconnect said resistor from said capacitor and connect a second resistor instead thereof, said resistors being variable and/or of different value in order to permit said second predetermined time to differ from said first predetermined time.

7. A liquid dispenser as claimed in claim 6 wherein upon actuation of said third switch means, said fourth switch means is latched to provide continuance of connection to said second resistor until deactuation of said second switch means occurs.

8. A liquid dispenser for dispensing a first liquid to a reservoir, said dispenser comprising a pumping device having an inlet adapted to receive said liquid and an outlet adapted to be placed in communication with said reservoir, and control means controlling operation of the pumping device and effecting operation of the pumping device to pump a metered amount of said first liquid into said reservoir, said control means comprising:

detector means for detecting, in use of the dispenser, the electrical conductivity of liquid in said reservoir and first switch means operated under control of the detector means to cause actuation of said pumping device, said detector means being responsive to a decrease in electrical conductivity of said liquid below a predetermined level to effect said operation of said first switch means and said actuation of the pumping device at least until sufficient said first liquid is added to the liquid in the reservoir to increase the conductivity at least up to said predetermined level, said detector means including circuit elements making up three arms of a bridge circuit, means coupled to spaced electrodes affixable in the liquid of the reservoir so that the fourth arm of the bridge circuit is made up of the effective resistance of liquid between said electrodes, a first controllable switch, and means for applying an alternating voltage across one pair of opposed junctions of said bridge circuit, said first controllable switch being connected between the other pair of opposed junctions of the bridge circuit so as to be sensitive to the existence of an out of balance voltage therebetween, caused by an increase of resistance between the electrodes above a predetermined resistance representing said predetermined level of conductivity, said first controllable switch to then be operated to effect said operation of said first switch means and said actuation of said pumping device, said first controllable switch deactuating said pumping device pursuant to a subsequent decrease of said resistance below said predetermined resistance.

9. A liquid dispenser as claimed in claim 8 wherein said detector means includes a second controllable switch having a control electrode and two main current carrying electrodes and which can be switched between conductive and non-conductive states existing between the main current carrying electrodes pursuant to application of a control voltage to the control electrode, said first controllable switch being connected to apply to said control electrode voltage of one polarity delivered from said supply, when the first controllable switch is operated, thereby to effect switching of said first controllable switch to a state of conduction and said second controllable switch then operating said first switch means to actuate said pumping device.

10. A liquid dispenser as claimed in claim 9 wherein said first controllable switch is connected to be turned on pursuant to detection of said out of balance voltage and turns off to effect said deactuation of said pumping device, and wherein a capacitor is arranged to be brought to a charged condition when the first controllable switch is operated and being coupled to maintain said control electrode at a potential sufficient to maintain the second controllable switch in said state of conduction for a predetermined period after turning off of said first controllable switch.

11. A liquid dispenser as claimed in claim 10, wherein said first switch means includes a relay connected to be energised when said second controllable switch means is placed in said conductive state and having contacts which, when the relay is energised, cause application of electric supply to said pumping device.

12. A liquid dispenser as claimed in claim 11 including second switch means operable to disconnect supply to said detector and first switch means and operable to directly apply said supply to said pumping device for operation thereof.

* * * * *